US006153984A

United States Patent [19]

Fishbein et al.

[11] Patent Number: 6,153,984

[45] Date of Patent: Nov. 28, 2000

[54] DIMMABLE LIGHTING SYSTEM FOR A PLURALITY OF GAS DISCHARGE LAMPS

[75] Inventors: Omri Fishbein; Ya'Akov Shofar, both of Kibbutz Ein Hashofet, Israel

[73] Assignee: Ein Hashofet Electrical Accesseries, Kibbutz Ein Hashofet, Israel

[21] Appl. No.: 09/193,050

[22] Filed: Nov. 16, 1998

[30] Foreign Application Priority Data

Mar. 12, 1998 [IL] Israel ..... 123661

[51] Int. Cl.[7] ..... G05F 1/00

[52] U.S. Cl. ..... 315/291; 315/58; 315/282; 315/324; 315/DIG. 4

[58] Field of Search ..... 315/56, 58, 324, 315/291, 307, 276, 282, 285, DIG. 4

[56] References Cited

U.S. PATENT DOCUMENTS 4,508,996 4/1985 Clegg et al. ..... 315/224
5,164,637 11/1992 Nilssen ..... 315/209 R
5,596,247 1/1997 Martich et al. ..... 315/56
5,608,289 3/1997 O'Carroll et al. ..... 315/58
5,637,964 6/1997 Hakkarainen et al. ..... 315/295

FOREIGN PATENT DOCUMENTS 94319 8/1994 Israel .

*Primary Examiner*—Haissa Philogene
*Attorney, Agent, or Firm*—Natter & Natter

[57] ABSTRACT

The invention provides a system for lighting a plurality of compact fluorescent lamps (CFL), each connectable in parallel to a power supply line via an adaptor, the system comprising a central dimming device connectable to receive power from mains and having outlet terminals for supplying predetermined, selectable power to the power supply line to which the plurality of CFL are connectable.

17 Claims, 1 Drawing Sheet

DIMMABLE LIGHTING SYSTEM FOR A PLURALITY OF GAS DISCHARGE LAMPS

FIELD OF THE INVENTION

The present invention relates to a lighting system, and more particularly to a system for lighting a plurality of compact fluorescent lamps (CFL). More specifically, the present invention is concerned with a lighting system utilizing CFL for lighting animal houses or cages, e.g., poultry houses for poultry breeding.

BACKGROUND OF THE INVENTION

Lighting in commercial poultry houses is a vital factor in the breeding process. The quality and intensity of the light must be carefully adjusted during the various stages of the growing period, in order to achieve the best economic results. For example, suitable lighting can control nervousness and can reduce cannibalism among the birds.

The poultry industry includes two main sectors: broilers and layers, each sector having its own specific recommendations regarding lighting during the growing and egg production periods, respectively.

At present, lighting in poultry houses is usually based on incandescent lamps controlled by an electronic dimmer. The dimmer enables the growers to adjust the lighting intensity continuously from 0–100%. Some growers replaced the incandescent bulbs with ordinary fluorescent lamps, in order to save energy costs. However, dimming of such lamps requires the heating of individual electrodes in each lamp, which is costly. The use of CFL by poultry growers requires complicated and expensive dimmers; hence, the preference of most growers is to use conventional incandescent lamps.

SUMMARY OF THE INVENTION

The present invention is intended to overcome the disadvantages of the known lighting systems by providing the following combination of features:

1) utilizing existing electrical supply systems;
2) energy saving by utilizing white or monochromatic CFL combined with robust electromagnetic adaptors, instead of using the wasteful incandescent bulbs; and
3) utilizing a single, non-expensive, robust electromagnetic central dimmer for a plurality of CFL.

While requiring a relatively modest investment, the present invention enables the poultry grower to save 90% of the electrical energy cost as compared with incandescent lighting, while improving the results of the breed.

In accordance with the present invention, there is therefore provided a system for lighting a plurality of compact fluorescent lamps (CFL), each connectable in parallel to a power supply line via an adaptor, said system comprising a central dimming device connectable to receive power from mains and having outlet terminals for supplying predetermined, selectable power to said power supply line to which said plurality of CFL are connectable.

The invention also provides a lighting system comprising a central dimming device connectable to receive power from mains and having outlet terminals connectable to a power supply line for supplying predetermined, selectable power to said power supply line, and a plurality of compact fluorescent lamps (CFL), each connectable in parallel to said power supply line via an adaptor.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

DETAILED DESCRIPTION OF PREFERRED EMBODIMENTS

Figure 1:
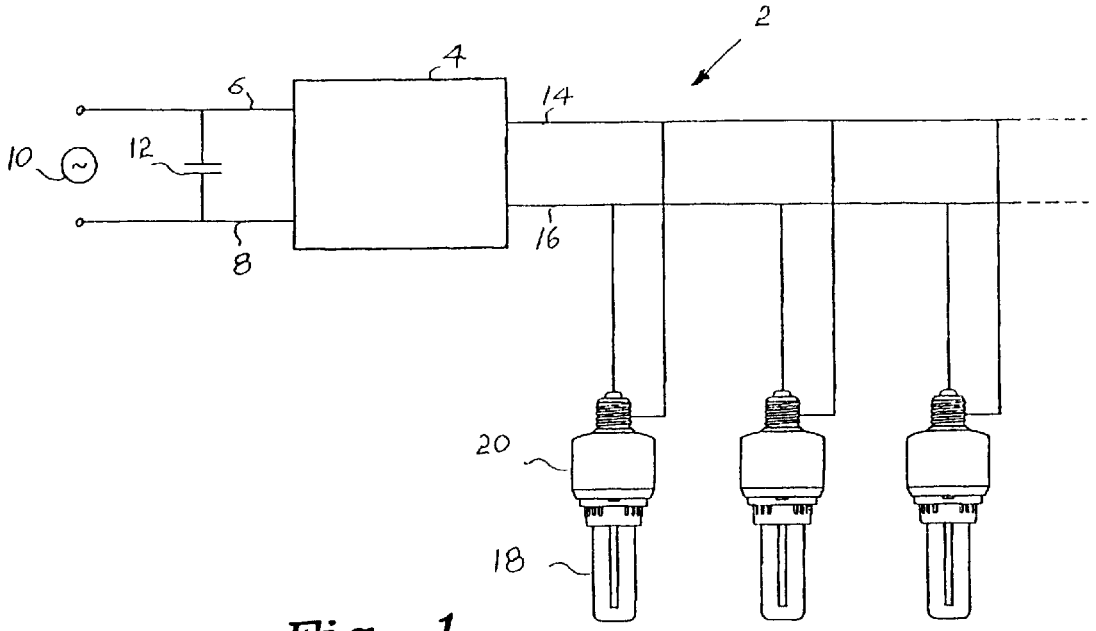
FIG. 1 is a schematic diagram illustrating the lighting system according to the present invention.

There is illustrated in FIG. 1 a schematic diagram of a lighting system 2, consisting of a central dimming device 4 having a first pair of terminals 6, 8 advantageously connectable to a mains 10, e.g., 230V, 50 Hz, via a power factor correction capacitor 12 (e.g., 90 $\mu$F/250 Vac). The dimming device 4 has a second pair of output terminals 14, 16, constituting a power supply line to which are connected a plurality of CFLs 18 (e.g., 9 W/66 green), each through an adaptor 20 (e.g., 9 W Orion, produced by Ein HaShofet). The adaptor 20 includes a coil-core ballast installed therein and is adapted to be connected to a standard incandescent bulb socket, as disclosed in Israel Patent No. 94319, the teachings of which are incorporated herein by reference.

The following are some examples of lamp types and spacings in poultry houses:

7 W/41 lamps are spaced at 3 meters from each other in a layers house;

9 W/41 lamps are spaced at 3 meters from each other in a broilers house;

9 W/66 lamps are spaced at 6 meters from each other in a broilers house. The greater spacing is possible due to the nearly monochromatic spectrum of this lamp (nearly monochromatic green color);

11 W/41 lamps are spaced at 3 meters for the breeders.

When applying the above examples in closed broiler houses, the lights should be on for 23 hours daily during the first week and 16–18 hours daily after the first week.

Figure 2:
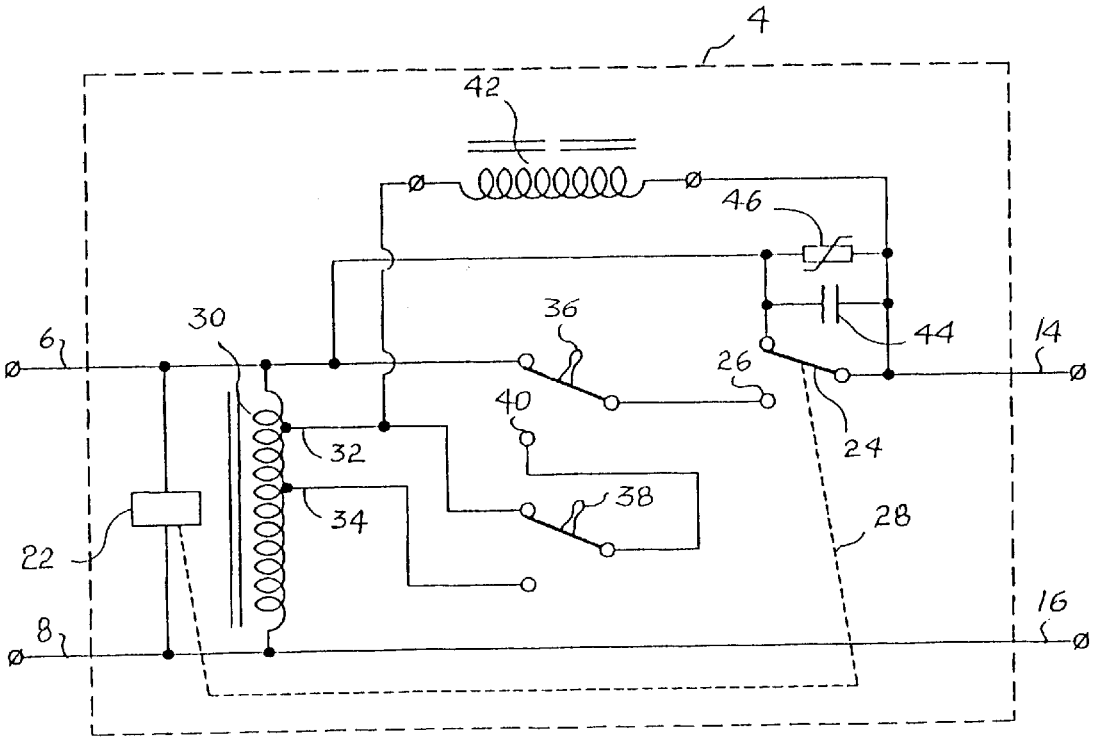
FIG. 2 is a circuit diagram of a preferred embodiment of a dimming device constituting a part of the lighting system of FIG. 1.

Referring to FIG. 2, there is shown a circuit diagram of a preferred dimming device 4, including a delay unit 22, e.g., a timer, governing the position of the switch 24 from a first position wherein the entire voltage of the mains is applied to the power supply line 14, 16 activating the lamps, to a second position contacting point 26, as indicated by the broken line 28, leading from the delay unit 22 to the switch 24. There is further included a selectable step-down voltage unit 30, e.g., an electromagnetic or electronic transformer having a first tapping 32 providing a first power rating of, e.g., 185V/8 A and a second tapping 34 of, e.g., 155V/6 A.

A first, manually operated switch 36 is interposed between the terminal 6 connectable to the mains and the switch 24. A second, manually operated switch 38 is located to selectively connect between tappings 32, 34 and contact point 40. In order to assure electrical continuity of the dimming device during the changeover of switch 24, there is provided a ballast 42 connected between the step-down voltage unit 30 and the output terminal 14. Across the switch 24, there are advantageously connected a capacitor 44 (e.g., 2 $\mu$F) and a varistor 46 (e.g., 95V) to protect the switch against unfavorable effects, e.g., voltage and current surges due to inductive loads present in the circuit. Instead of the ballast 42, any other kind of impedance could just as well be used.

As can be understood, upon connecting the lighting system 2 to the mains, the entire mains voltage is applied to the lamps, which are ignited and warm up. About 15 seconds after ignition of the lamps, the time delay unit 22 causes contact 24 to change its position from the shown one, to make contact with point 26. Depending upon the setting of the full-output/dimming switch 36 and medium/low light output switch 38, after the ignition and warm-up period, the switch 24 automatically transfers the selected power to the power line 14, 16 for effecting the desired light intensity level.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A system for lighting a plurality of compact fluorescent lamps (CFL), each connectable in parallel to a power supply line via an adaptor, said system comprising:

a central dimming device connectable to receive power from mains and having outlet terminals for supplying predetermined, selectable power to said power supply line to which said plurality of CFL are connectable, a selectable step-down voltage unit connectable to said mains, having at least one power output of a voltage lower than the voltage of the mains for providing selected voltages to said power supply line, and an impedance connected in circuit for ensuring electrical continuity to said power supply line upon switching from one selected voltage to another.

2. The system as claimed in claim 1, wherein each of said adaptors comprises a coil-core ballast installed therein, and is connectable to a standard socket of an incandescent bulb.

3. The system as claimed in claim 1, wherein said central dimming device further comprises a time delay unit for governing the time wherein said predetermined selectable power is supplied to the power supply line.

4. The system as claimed in claim 1, wherein said step-down voltage unit is a transformer having at least one tapping connectable to a full-output/dimming switch.

5. The system as claimed in claim 4, wherein said impedance is a shunt ballast connected between said switch and said power supply line.

6. The system as claimed in claim 4, further comprising circuit means connected across said switch for protecting said switch against voltage and current surges.

7. The system as claimed in claim 1, wherein said step-down voltage unit has at least two tappings and said system further comprises a medium/low light output switch manually settable to a selectable output light intensity.

8. A lighting system comprising:

a central dimming device connectable to receive power from mains and having outlet terminals connectable to a power supply line for supplying predetermined, selectable power to said power supply line, a plurality of compact fluorescent lamps (CFL), each connectable in parallel to said power supply line via an adaptor, a selectable step-down voltage unit connectable to said mains having at least one power output of a voltage lower than the voltage of the mains for providing selected voltages to said power supply line, and an impedance connected in circuit for ensuring electrical continuity to said power supply line upon switching from one selected voltage to another.

9. The system as claimed in claim 8 wherein each of said adaptors comprises a coil-core ballast installed therein, and is connectable to a standard socket of an incandescent bulb.

10. The system as claimed in claim 8 wherein said central dimming device further comprises a time delay unit for governing the time wherein said predetermined selectable power is supplied to the power supply line.

11. The system as claimed in claim 8 wherein said impedance is a shunt ballast connected between said switch and said power supply line.

12. The system as claimed in claim 8 wherein said step-down voltage unit has at least two tappings and said system further comprises a medium/low light output switch manually settable to a selectable output light intensity.

13. The system as claimed in claim 8 wherein said step-down voltage unit is a transformer having at least one tapping connectable to a full-output/dimming switch.

14. The system as claimed in claim 13 wherein said impedance is a shunt ballast connected between said switch and said power supply line.

15. The system as claimed in claim 13, further comprising circuit means connected across said switch for protecting said switch against voltage and current surges.

16. A system for lighting a plurality of compact fluorescent lamps (CFL), each connectable in parallel to a power supply line via an adaptor, said system comprising:

a central dimming device connectable to receive power from a standard mains and having outlet terminals for supplying predetermined selectable power at a low frequency between 50–60 Hz to said power supply line to which said plurality of CFL are connectable.

17. A lighting system, comprising:

a central dimming device connectable to receive power from a standard mains and having outlet terminals connectable to a power supply line for supplying predetermined selectable power to said power supply line at a low frequency between 50–60 Hz, and a plurality of compact fluorescent lamps (CFL), each connectable in parallel to said power supply line via an adaptor.

* * * * *